US010753557B2

(12) United States Patent
Yang

(10) Patent No.: US 10,753,557 B2
(45) Date of Patent: Aug. 25, 2020

(54) SYSTEM OF LOCALIZED GENERAL LIGHTING, A CONTROL METHOD THEREOF, AND A TABLE LAMP USING SAID SYSTEM OF LOCALIZED GENERAL LIGHTING

(71) Applicant: Shenzhen Yuanrunxin Electronics Co., Ltd., Guangdong (CN)

(72) Inventor: Tao Yang, Tianjin (CN)

( * ) Notice: Subject to any disclaimer, the term of this patent is extended or adjusted under 35 U.S.C. 154(b) by 0 days.

(21) Appl. No.: 16/035,694

(22) Filed: Jul. 15, 2018

(65) Prior Publication Data

US 2019/0390826 A1 Dec. 26, 2019

(30) Foreign Application Priority Data

Jun. 26, 2018 (CN) ..... 2018 1 0671672

(51) Int. Cl.

| | |
|---|---|
| ***F21S 6/00*** | (2006.01) |
| ***F21V 21/22*** | (2006.01) |
| ***F21V 23/00*** | (2015.01) |
| ***F21S 10/02*** | (2006.01) |
| ***F21V 23/04*** | (2006.01) |

(52) U.S. Cl.

CPC ..... *F21S 6/002* (2013.01); *F21S 10/023* (2013.01); *F21V 21/22* (2013.01); *F21V 23/003* (2013.01); *F21V 23/04* (2013.01); *F21V 23/0435* (2013.01)

(58) Field of Classification Search

CPC ..... F21S 10/023; F21S 6/002; F21S 6/003; F21S 13/12; F21V 21/22

See application file for complete search history.

(56) References Cited

U.S. PATENT DOCUMENTS

| | | | | |
|---|---|---|---|---|
| 7,052,157 | B1 * | 5/2006 | Lau | F21S 6/002 362/216 |
| 7,628,508 | B2 * | 12/2009 | Kita | F21S 8/086 362/231 |
| 9,097,824 | B2 * | 8/2015 | Vissenberg | G02B 6/0018 |
| 9,995,447 | B2 * | 6/2018 | Rooymans | F21S 8/086 |
| 2008/0031000 | A1 * | 2/2008 | Adrien | E01F 9/65 362/419 |
| 2010/0321930 | A1 * | 12/2010 | Watanabe | F21S 8/086 362/184 |

(Continued)

*Primary Examiner* — Leah Simone Macchiarolo

(74) *Attorney, Agent, or Firm* — Prakash Nama; Global IP Services, PLLC

(57) ABSTRACT

A system of localized general lighting, embodied in a table lamp, the table lamp has more than one lamp, and lights emitted by each lamp define a light illumination tier; wherein the system has a first illumination tier and a second illumination tier, the first illumination tier is positioned below the second illumination tier; the first illumination tier illuminates lights having homogeneous intensity, low illumination height, strong illuminance and small area coverage; the second illumination tier is positioned above the first illumination tier; the second illumination tier illuminates lights having homogeneous intensity, high illumination height, weak illuminance and large area coverage; the area coverage of the lights illuminated by the second illumination tier superimposes the area coverage of the lights illuminated by the first illumination tier so that the lights from the second illumination tier and the lights from the first illumination tier are mixed at a predetermined ratio.

9 Claims, 11 Drawing Sheets

(56) References Cited

U.S. PATENT DOCUMENTS

| | | | | |
|---|---|---|---|---|
| 2014/0071677 | A1* | 3/2014 | Pickard | F21S 8/086<br>362/294.02 |
| 2017/0174090 | A1* | 6/2017 | Lakamp | H02J 3/383 |
| 2017/0322364 | A1* | 11/2017 | Girotto | G02B 6/0076 |

* cited by examiner

SYSTEM OF LOCALIZED GENERAL LIGHTING, A CONTROL METHOD THEREOF, AND A TABLE LAMP USING SAID SYSTEM OF LOCALIZED GENERAL LIGHTING

BACKGROUND OF THE INVENTION

The present invention relates to the field of lighting, and more specifically relates to a system of localized general lighting, a control method thereof, and a table lamp using said system of localized general lighting.

As known, a table lamp currently available in the market focuses the lights on a small area to facilitate working and studying. Incandescent bulbs, energy saving bulbs or LED light beads are generally used by the table lamp. The table lamp produces great light contrasting effect with respect to the surrounding environment which may easily lead to eye fatigue after a long period of use, thereby causing eye diseases. In particular, youngsters using such a table lamp of such high illumination for a long period of time may suffer from eye fatigue which in a long run will be developed into short-sightedness. As the customers are having higher and higher standard for eye protection, a kind of eye protection table lamp has emerged to reduce irritation to user's eyes by its way of adjusting the brightness of the lamp. However, the light contrast with respect to the surrounding environment is still great in this kind of eye protection table lamp. Regardless of the type of table lamp, the deficiency of eye fatigue is still present.

BRIEF SUMMARY OF THE INVENTION

In view of the aforesaid disadvantages now present in the prior art, the present invention provides a solution that can greatly protect eyesight. The present invention is achieved as follows:

A system of localized general lighting, embodied in a table lamp, the table lamp has more than one lamp, and the lights emitted by each lamp define a light illumination tier; wherein the system comprises a first illumination tier and a second illumination tier, the first illumination tier is positioned below the second illumination tier; the first illumination tier illuminates lights having homogeneous intensity, low illumination height, strong illuminance and small area coverage; the second illumination tier is positioned above the first illumination tier; the second illumination tier illuminates lights having homogeneous intensity, high illumination height, weak illuminance and large area coverage; the area coverage of the lights illuminated by the second illumination tier superimposes the area coverage of the lights illuminated by the first illumination tier.

Further, heights and angles of both the first illumination tier and the second illumination tier are adjustable.

Further, the first illumination tier and the second illumination tier are simultaneously activated; brightness and color temperatures of both the first illumination tier and the second illumination tier are simultaneously adjustable using a control knob.

A control system that controls the table lamp in which the system of localized general lighting is embodied; the control system comprises a control center, a wireless emission module, a mechanism control module, a human-machine interface module, a communication module and a power control module; wherein:

the control center controls brightness and color temperatures etc. of the table lamp so as to provide comfortable visual experience which brightens up user's emotion; intelligent interconnection and intercommunication, powerful power management, versatile mechanical movements of power arms, and satisfactory human-machine interface are also provided;

the mechanism control module adjusts positions and angles of the illumination tiers via mechanical movements of the power arms;

the human-machine interface module comprises a visual image unit, a receiver unit, and an operative movement unit; operative movements that achieve control purpose is implemented through the operative movement unit; the receiver unit receives the operative movements; and the visual image unit recognizes the operative movements and outputs corresponding command codes;

the mechanism control module adjusts illuminating ranges of the illumination tiers via mechanical movements of the power arms;

the communication module comprises an Ethernet, 3G/4G network, and a mobile terminal to achieve intelligent network communication.

A table lamp using the system of localized general lighting of the present invention, comprising a base; a main shaft fixedly mounted on the base; a primary lamp connected to the main shaft via a first branch, and a secondary lamp connected also to the main shaft via a second branch; lights illuminated by the primary lamp define the first illumination tier; lights illuminated by the secondary lamp define the second illumination tier; the secondary lamp is positioned higher than the primary lamp; the second illumination tier of the secondary lamp covers the first illumination tier of the primary lamp.

Further, a charging port is provided on the base to charge the table lamp; the control knob on the base simultaneously controls the primary lamp and the secondary lamp; the primary lamp and the secondary lamp are simultaneously activated by the control knob; different color temperatures of the primary lamp and the secondary lamp are also simultaneously switched by using the control knob; and the brightness of both the primary lamp and the secondary lamp are also simultaneously adjustable by using the control knob.

Further, a frame that connects the primary lamp and the secondary lamp is adjustable with respect to its height and angle; a distance between the primary lamp and the secondary lamp is 10 cm-25 cm.

The present invention has the following beneficial effects: reducing frequent contraction of pupil within a unit time that causes eye muscle fatigue, accordingly, eye fatigue is relieved. Also, the present invention enables wider range of illumination, even degree of illuminance and provides protection against glaring.

BRIEF DESCRIPTION OF THE DRAWINGS

FIG. 2-1 is a C plane light distribution curve diagram of a prior art table lamp.

FIG. 2-2 is a C plane light distribution curve diagram of the table lamp according to the present invention.

FIG. 3-1 is another illustration of the C plane light distribution curve diagram of the prior art table lamp.

FIG. 3-2 is another illustration of the C plane light distribution curve diagram of the table lamp according to the present invention.

FIG. 4-1 is an isocandela curve diagram of the prior art table lamp.

FIG. 4-2 is an isocandela curve diagram of the table lamp according to the present invention.

FIG. 5-1 is a space isoilluminance curve of the prior art table lamp.

FIG. 5-2 is a space isoilluminance curve of the table lamp according to the present invention.

FIG. 6-1 is an illumination-distance diagram of the prior art table lamp.

FIG. 6-2 is an illumination-distance diagram of the table lamp according to the present invention.

DETAILED DESCRIPTION OF THE INVENTION

An embodiment of the present invention will be described clearly and comprehensively below with reference to the drawings of the embodiment. Obviously, the embodiment as will be described below is only an exemplary embodiment and does not include all possible implementations of the present invention. Any other embodiments based on the teachings of the present invention, conceivable by a person skilled in this field of art without any additional inventive effort should fall within the scope of protection of the present invention.

Figure 1:
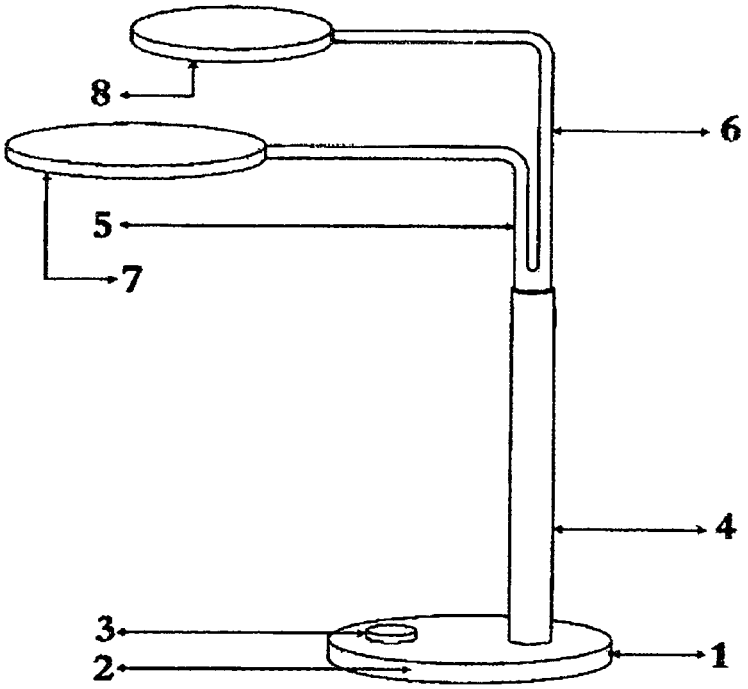
FIG. 1 is a table lamp according to the present invention.
Figures 1, 2:
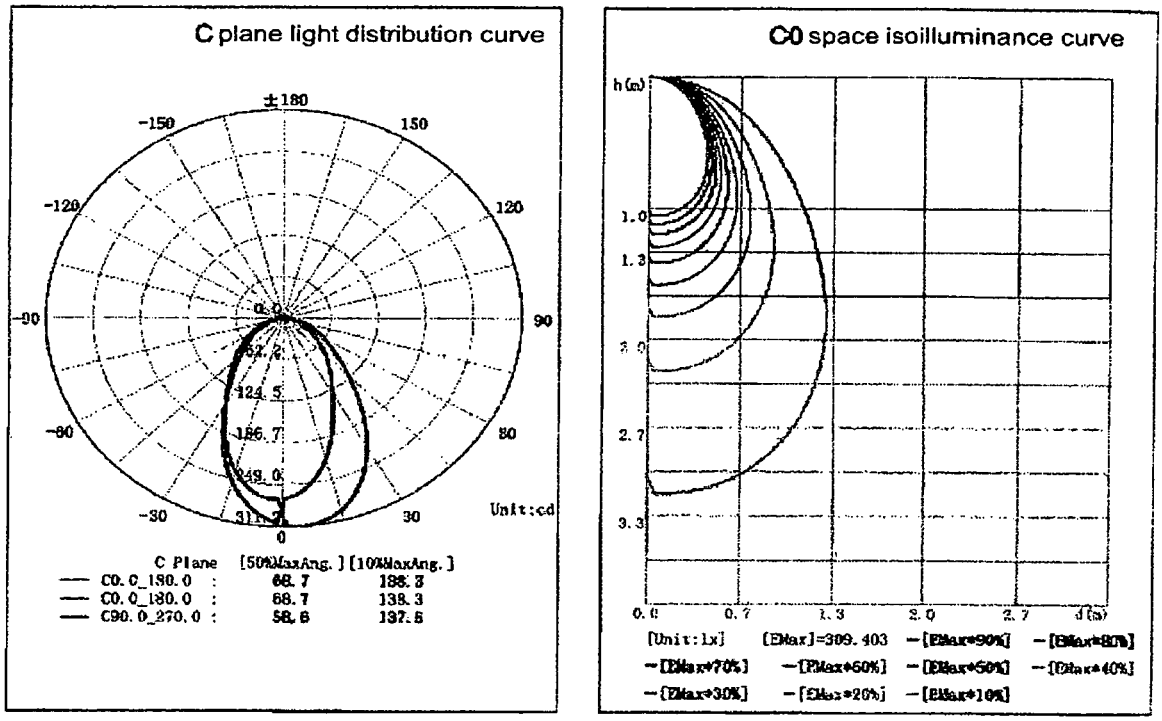
Figure 2:
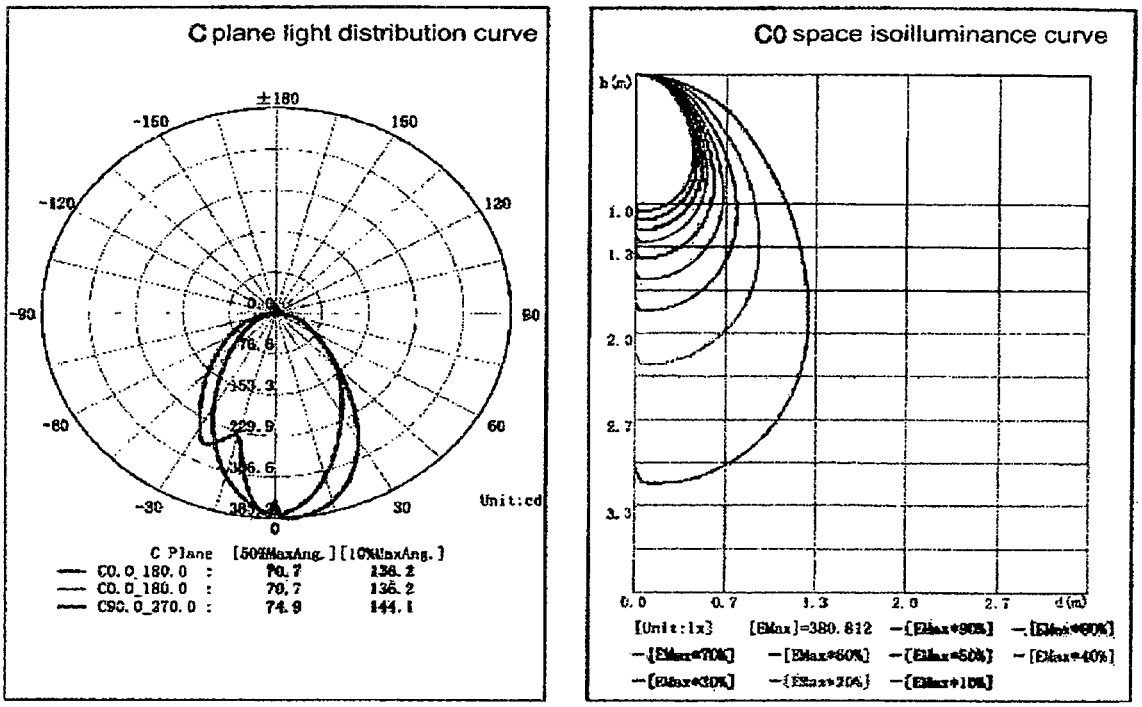
Figures 1, 3:
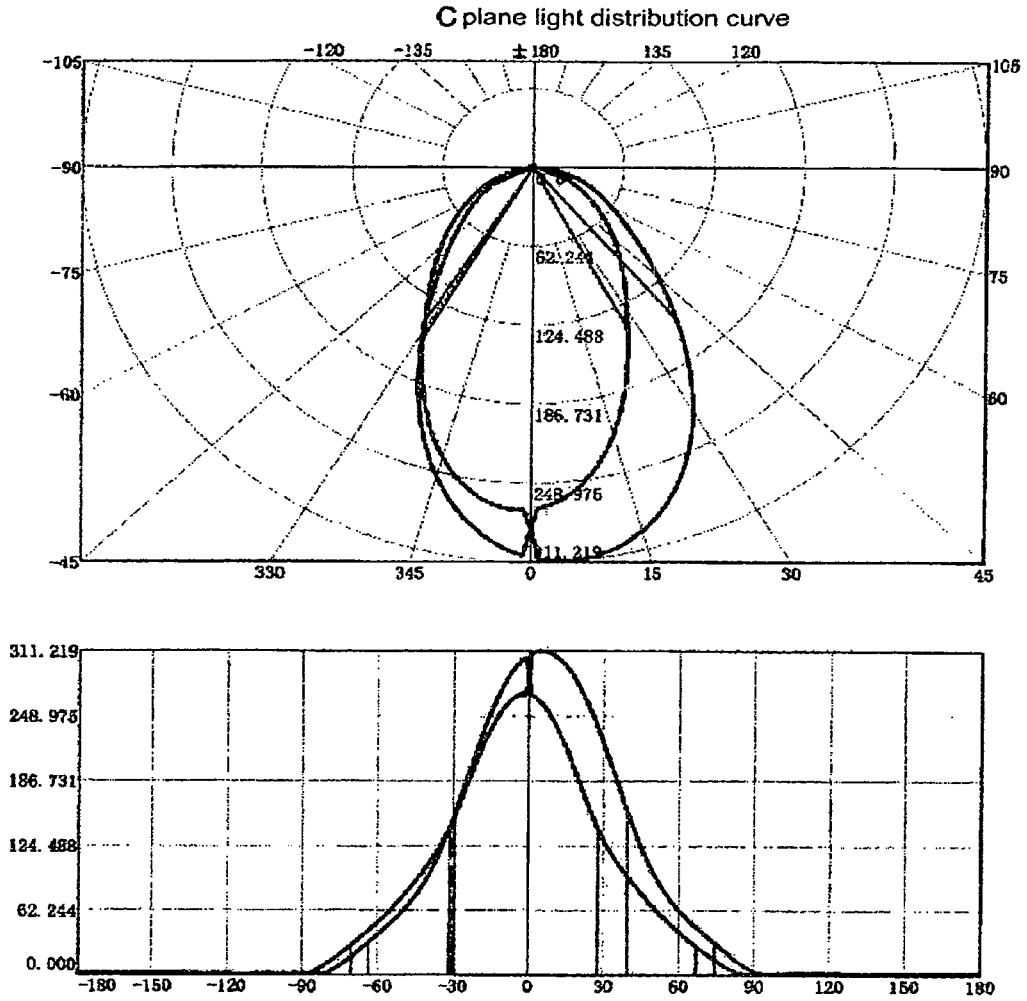
Figures 2, 3:
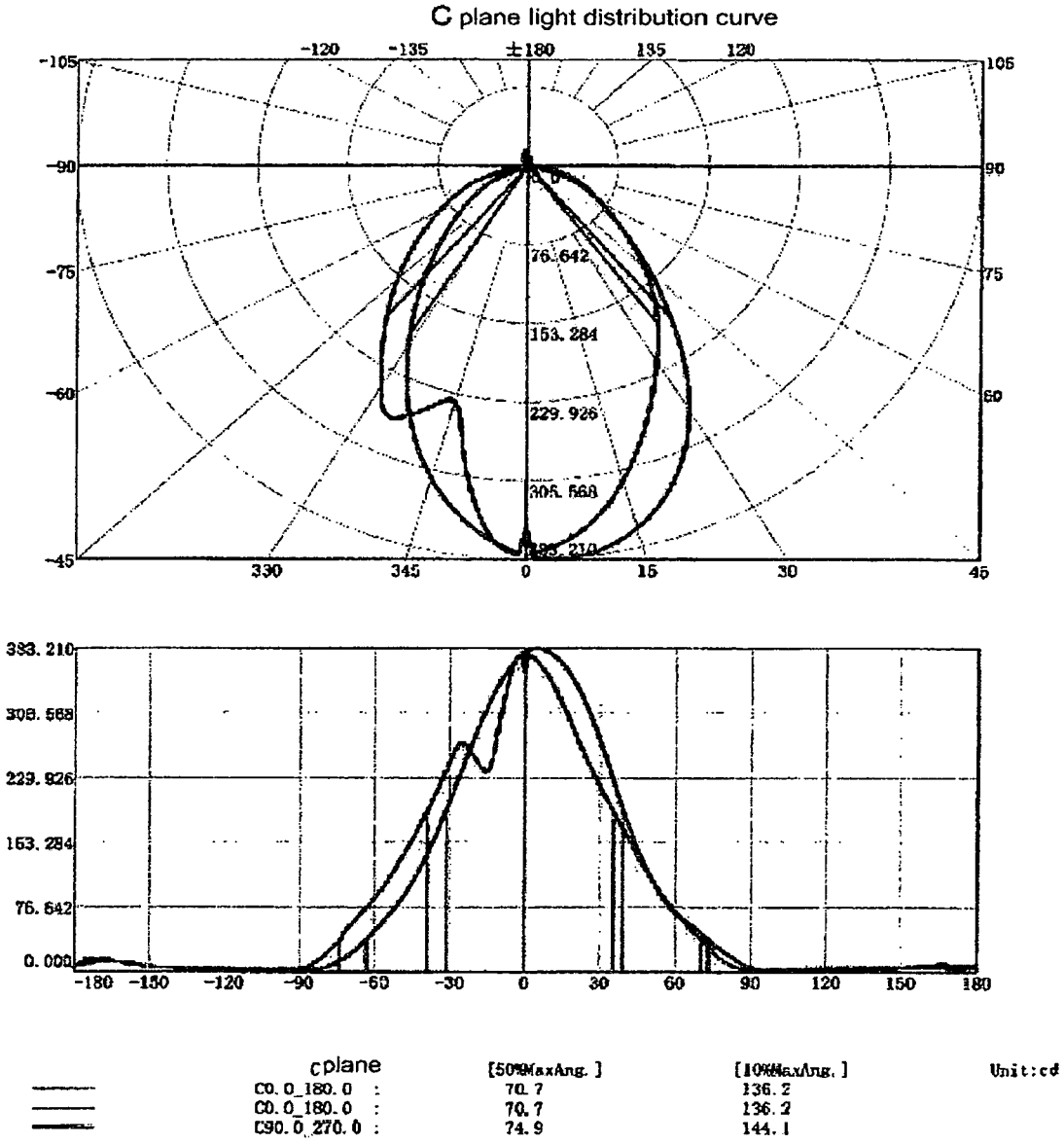
Figures 1, 4:
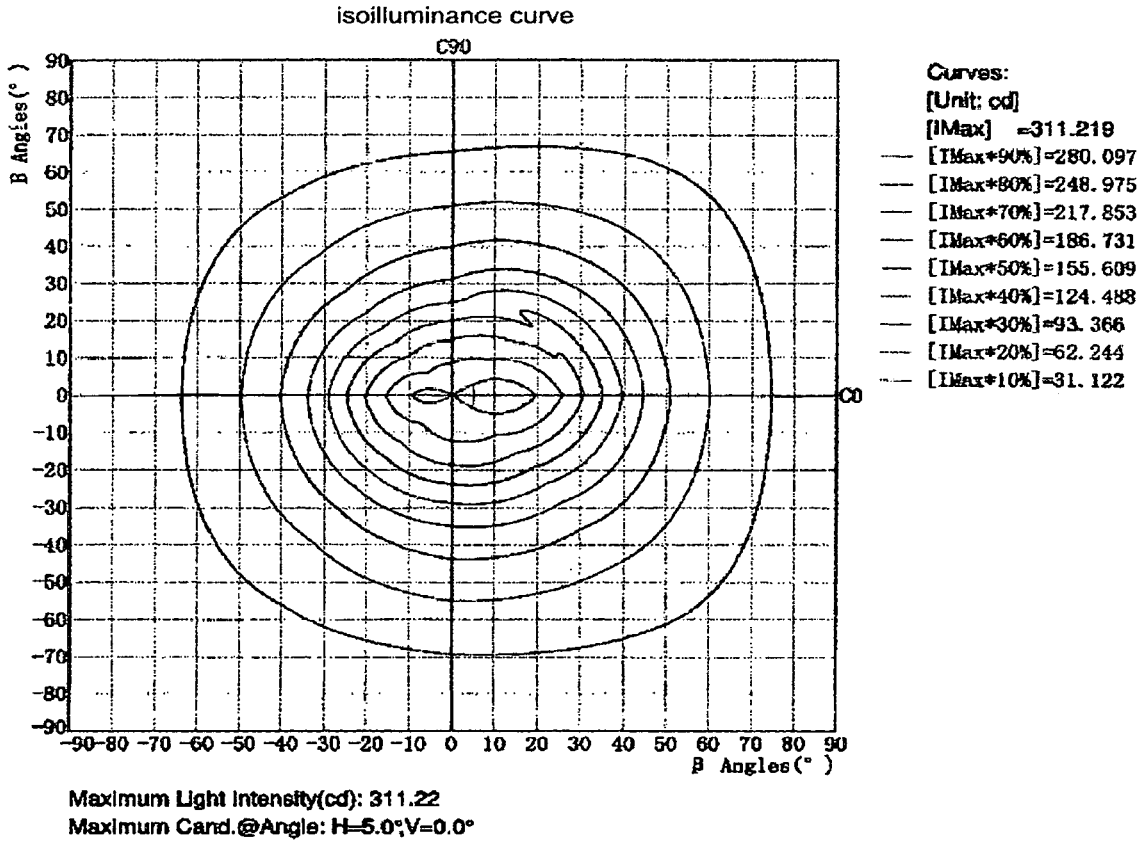
Figures 2, 4:
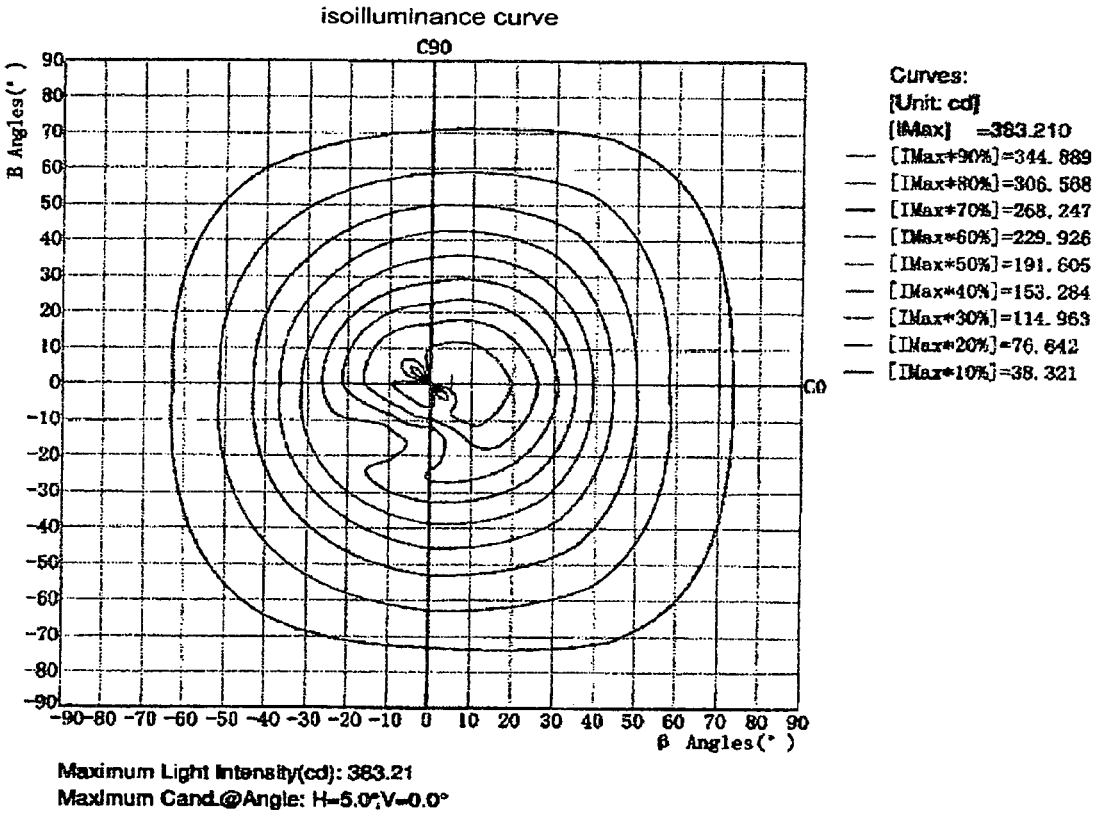
Figures 1, 5:
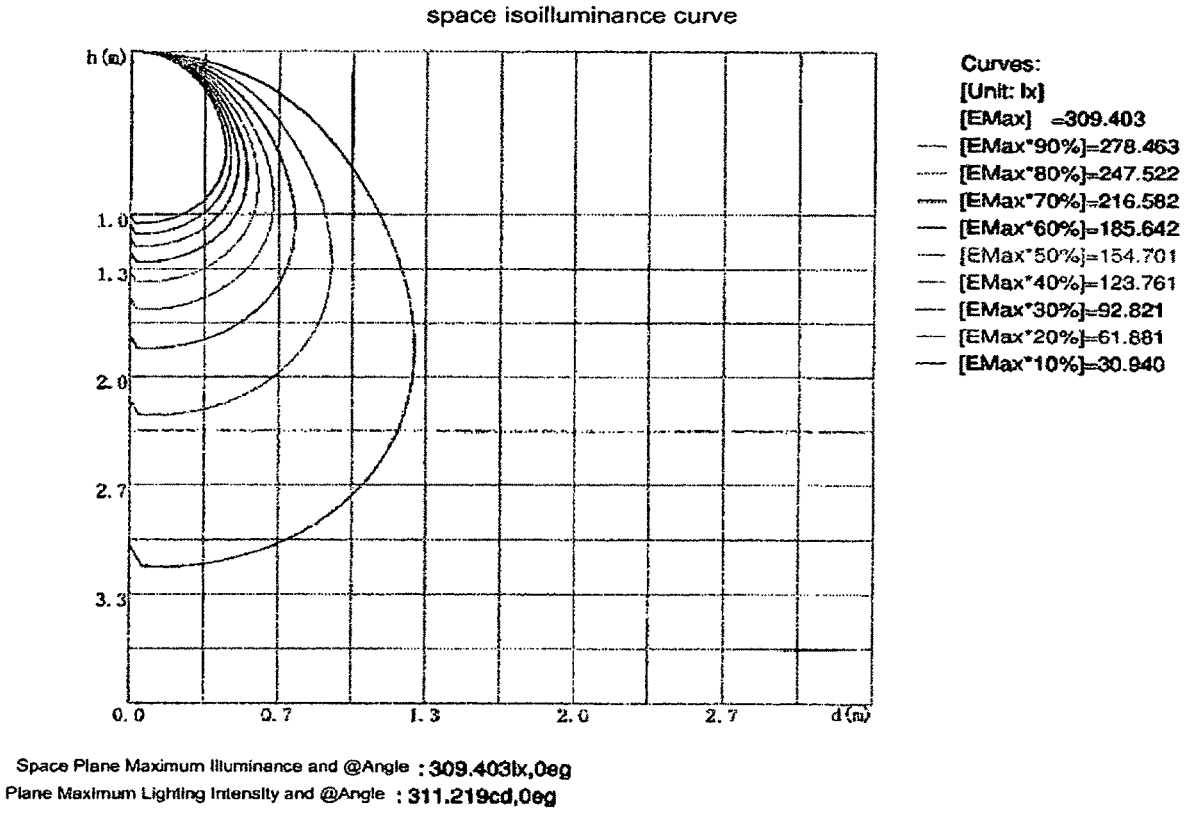
Figures 2, 5:
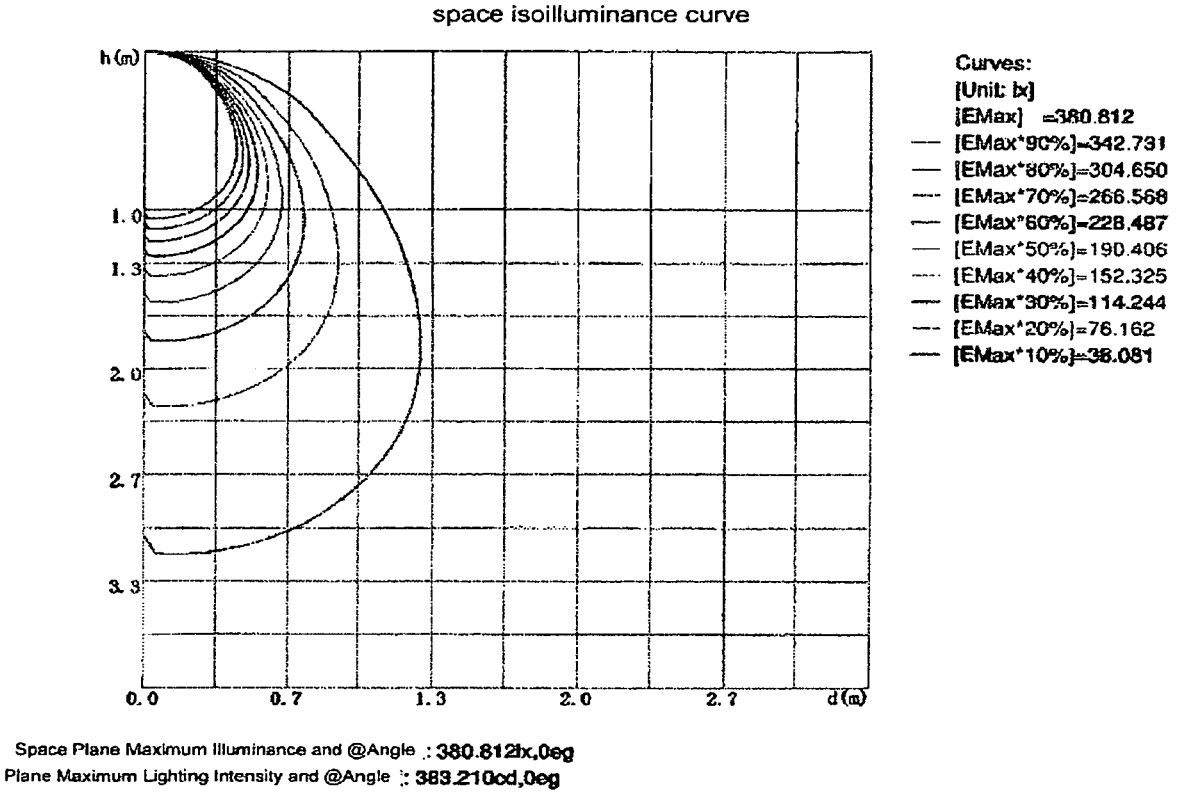
Figures 1, 6:
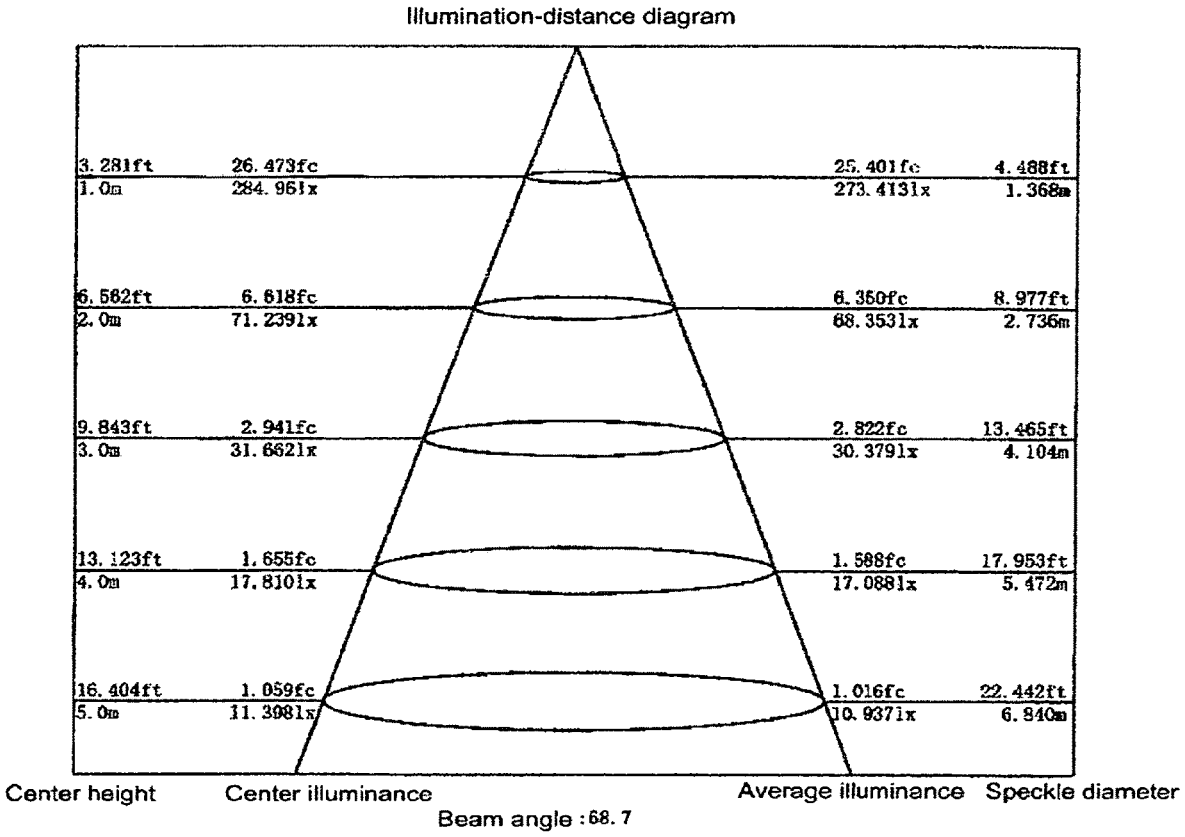
Figures 2, 6:
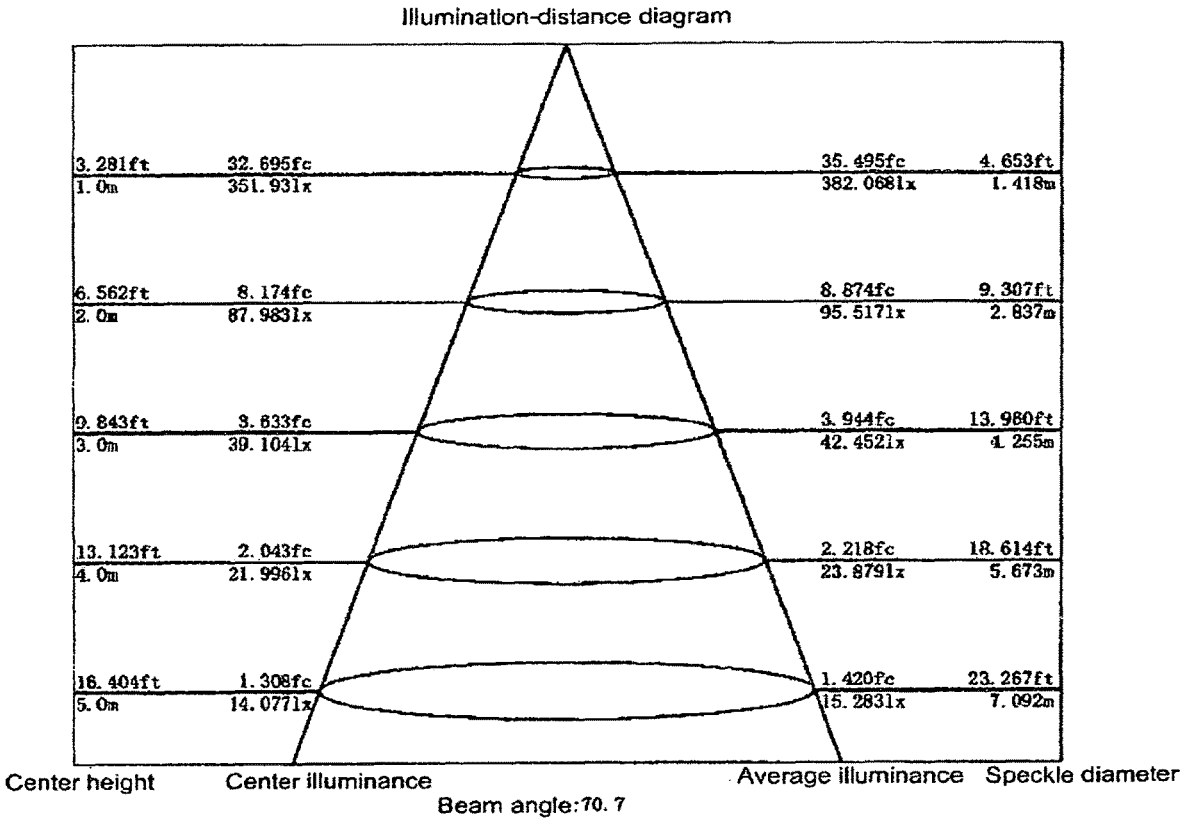

As shown in FIG. 1, a table lamp employing localized general lighting of the present invention comprises a base 2; a main shaft 4 is fixedly mounted on the base 2; a primary lamp 7 is connected to the main shaft 4 via a first branch 5, and a secondary lamp 8 is connected also to the main shaft via a second branch 6; lights illuminated by the primary lamp 7 define a first illumination tier; lights illuminated by the secondary lamp 8 define a second illumination tier; the secondary lamp 8 is positioned higher than the primary lamp 7; the second illumination tier of the secondary lamp 8 covers the first illumination tier of the primary lamp 7; a control knob 3 is fixed on the base 2 to control both the primary lamp 7 and the secondary lamp 8.

In the present embodiment, a charging port is provided on the base 2 to charge the table lamp; primary illumination from the primary lamp and light irradiation from the secondary lamp are simultaneously activated by pressing and holding the control knob 3; different color temperatures, namely 3000K, 4000K and 5000K of the primary illumination and of the light irradiation can be simultaneously switched by simply tapping the control knob 3; the control knob 3 may also simultaneously adjust the brightness of both the primary illumination and the light irradiation; heights and angles of both the primary illumination and the light irradiation can also be adjusted to satisfy different needs of a user.

The present invention is not limited to the above mentioned controls and color temperatures during actual practice.

A system of localized general lighting is embodied in the table lamp described above; the system comprises the first illumination tier defined by the lights from the primary lamp, the second illumination tier defined by the lights from the secondary lamp, wherein the first illumination tier is positioned below the second illumination tier; the first illumination tier illuminates lights having homogeneous intensity, low illumination height, strong illuminance and small area coverage; the lights illuminated by the first illumination tier serve the function of providing lighting; the second illumination tier is positioned above the first illumination tier; the second illumination tier illuminates lights having homogeneous intensity, high illumination height, weak illuminance and large area coverage; the area coverage of the lights illuminated by the second illumination tier superimposes the area coverage of the lights illuminated by the first illumination tier; from a side view, it can be seen that the lights of the first illumination tier are brighter than the lights of the second illumination tier; however, the lights for the second illumination tier has a larger coverage.

The control method according to the present invention can achieve simultaneous control of the primary lamp and the secondary lamp via a software control system comprising a control center, a wireless emission module, a mechanism control module, a human-machine interface module, a communication module and a power control module electrically connected on a circuit board of the table lamp.

The human-machine interface module comprises a visual image unit, a receiver unit (e.g. via thermal infrared), and an operative movement unit. The operative movement unit outputs operative movements based on information preset in the operative movement unit and according to movements of a user's body parts such as hands or other body parts; the receiver unit receives the operative movements; and the visual image unit recognizes the operative movements to form corresponding command codes; the control center outputs commands to control the table lamp according to the command codes. The human-machine interface module recognizes the user's movements performed according to the user's intention in order to control the table lamp, and contains information which renders the user's movements meaningful so as to be user friendly.

The communication module is in communication with a mobile terminal such as a mobile phone via Ethernet and 3G/4G network, in order to achieve mutual transmission of digital information. For example, by using an application (APP) in the mobile terminal, information can be transmitted to the table lamp via the communication module. Usually, certain parameters of the table lamp such as brightness, timing, color temperature etc. are configured to the table lamp by using the APP, and once the table lamp receives the configurations, the control center executes corresponding operations based on preset information.

The control center is generally an intelligent MCU that controls other modules; in a specific embodiment of the present invention, the MCU is ARM Cortex-M3 running @ 96 MHz, with 128K byte SRAM chip and 32 bit RISC core, a max frequency of 240 MHz, supporting DSP commands, integrated with FPU to support floating point calculation; and FFT accelerator supporting max. 1024 bit complex number FFT/IFFT calculation or 2048 bit real number FFT/IFFT calculation; a built-in 16 Mbit SPI Flash integrated with 224 KB SRAM (having 4 KB TCM), 32 KB (I-Cache) and 32 KB(D-Cache) for storing codes and data; built-in EFUSE configured storage; Serial Debug Port (SDP) which debugs breakpoints and tracks codes. The MCU as described above is sufficient to achieve simultaneous control on the table lamp, i.e. simultaneous control of the primary lamp and the secondary lamp of the table lamp.

The control center is responsible for the brightness, color temperature and glaring etc. of the table lamp so that user's eyes may feel comfortable and stay healthy.

The wireless emission module has a handshaking relationship with and is in communication with peripheral devices for mutual information exchanges in order to achieve control. For example, the wireless emission module is in communication with the mobile terminal.

The mechanism control module achieves positional changes of power arms by mechanical movements, such as the power arms of the structure shown in FIG. 1, so as to allow a more desirable lighting effect of the table lamp, and allow the illumination of the table lamp to be more comfortable to human eyes. The mechanism control module changes lighting effects intelligently via mechanical power arms that move smoothly. By using the mechanism control module, the heights and positioning angles of both the primary lamp and the secondary lamp as well as a distance between the primary lamp and the secondary lamp can be controlled. The distance between the primary lamp and the secondary lamp is 10 cm-25 cm; when the distance is 10 cm, the first illumination tier of the primary lamp is inclusive within the second illumination tier of the secondary lamp, therefore, the two illumination tiers have no obvious difference with respect to their brightness; when the distance is 25 cm, brightness of the two illumination tiers shows an obvious difference, and the second illumination tier has a larger area coverage than the first illumination tier in that, apart from superimposing the first illumination tier, the second illumination tier may have extended coverage over human bodies such that the human bodies are positioned under the second illumination tier so as to achieve a better effect of the present invention.

Data as reflected and represented with reference to FIGS. 2-1, 2-2, 3-1, 3-2, 4-1, 4-2, 5-1, 5-2, 6-1, 6-2, wherein FIGS. 2-1, 3-1, 4-1, 5-1 and 6-1 are figures concerning the prior art table lamp, and FIGS. 2-2, 3-2, 4-2, 5-2 and 6-2 are figures concerning the table lamp of the present invention, is summarized in the following tables:

In the tables, single light source represents the prior art table lamp; tiered double light source represents the table lamp according to the embodiment of the present invention.

TABLE 1

| Comparison between light distribution curves: | | | | | |
|---|---|---|---|---|---|
| Single light source | | | Tiered double light source | | |
| Parameter of light source | Parameter of illumination | | Parameter of light source | Parameter of illumination | |
| Nominal luminous flux (lm): 450.330 lm | Luminous flux (lm): 450.328 | Diffusion angle (10% Imax): 138.3 (°) | Nominal luminous flux (lm): 677.010 lm | Luminous flux (lm): 677.011 | Diffusion angle (10% Imax): 136.2 (°) |
| Nominal power (W): | Power (%): 100.00 | Downward luminous flux lm & percentage: 441.707 lm 98.09% | Nominal power (W): | Power (%): 100.00 | Downward luminous flux lm & percentage: 651.812 lm 96.28% |
| Nominal voltage (V): | Efficiency ratio (lm/W): 41.314 | Upward luminous flux lm & percentage: 8.621 lm 1.91% | Nominal voltage (V): | Efficiency ratio (lm/W): 48.015 | Upward luminous flux lm & percentage: 25.199 lm 3.72% |
| Tested power (W): 10.900 | Max candela (cd): 311.219 | S/MH: C0_180 = 1.04 C90_270 = 0.84 | Tested power (W): 14.100 | Max candela (cd): 383.210 | S/MH: C0_180 = 1.06 C90_270 = 1.03 |
| Quantity: 1 | Max candela@angle (°): C = 0.0 γ = 5.0 | CIE type: Semi-Direct | Quantity: 2 | Max candela@angle (°): C = 0.0 γ = 5.0 | CIE type: Semi-Direct |
| Tested electrical parameters (V, A, pf): 220.5, 0.113, 0.437 | Beam angle (50% Imax): 68.7 (°) | ErP φ use (90°): 288.330 lm | Tested electrical parameters (V, A, pf): 220.4, 0.142, 0.450 | Beam angle (50% Imax): 70.7 (°) | ErP φ use (90°): 415.728 lm |
| Size (W * L * H): 0.040 m * 0.260 m * 0.010 m | Left = −29.1°, Right = 39.6° | IRF (%): 175.448 | Size (W * L * H): 0.040 m * 0.260 m * 0.010 m | Left = −31.4°, Right = 39.3° | IRF (%): 148.265 |

TABLE 2

| Comparison between light planes | | | | |
|---|---|---|---|---|
| Unit: cd C Plane | Single light source 50% MaxAng. | Tiered double light source 50% MaxAng | Single light source 10% MaxAng. | Tiered double light source 0% MaxAng |
| C0.0_180.0 | 68.7 | 70.7 | 138.3 | 136.2 |
| C0.0_180.0 | 68.7 | 70.7 | 138.3 | 136.2 |
| C90.0_270.0 | 58.6 | 74.9 | 137.5 | 144.1 |

TABLE 3

| Comparison between illuminance | | | | | | | | | | |
|---|---|---|---|---|---|---|---|---|---|---|
| | Single light source | Tiered double light source | Single light source | Tiered double light source | Single light source | Tiered double light source | Single light source | Tiered double light source | Single light source | Tiered double light source |
| Center brightness | | | | | | | | | | |
| | 1M | | 2M | | 3M | | 4M | | 5M | |
| Center illuminance | 284.96 lx | 351.93 lx | 71.239 lx | 87.983 lx | 31.662 lx | 39.104 lx | 17.810 lx | 21.996 lx | 11.398 lx | 14.077 lx |
| Average illuminance | 273.413 lx | 382.068 lx | 68.353 lx | 95.517 lx | 30.379 lx | 42.452 lx | 17.088 lx | 23.879 lx | 10.937 lx | 15.283 lx |
| Speckle diameter | 1.368 m | 1.418 m | 2.736 m | 2.837 m | 4.104 m | 4.255 m | 5.472 m | 5.673 m | 6.840 m | 7.092 m |

As shown in the above tables, the luminous flux as well as ErP φ use of the tiered table lamp of the present invention show significant improvements. Since the tiered table lamp provides a wide range of illumination, therefore the present invention has the beneficial effect of solving the problem of eye fatigue due to the use of table lamp for a long period of time.

Given that the body posture an eye level remain unchanged, use of the present invention with mixed high and low illumination by the primary lamp and the secondary lamp at a certain ratio enables softer lighting effect that has smooth transition between brightly lighted area and dimly lighted area, thereby reducing frequent contraction of pupil within a unit time that causes eye muscle fatigue, accordingly, eye fatigue is relieved. Further, double tier lighting enables wider range of illumination, even degree of illuminance and protection against glaring. The heights of the two tiers of lighting, their angles, color temperatures and illuminance can be adjusted to be the most comfortable to each of different individual users so that each and every user may feel comfortable to use the present invention.

An embodiment of the present invention is shown and described above. It should be understood that, various changes, modifications, replacements and alternative configurations of the disclosed embodiment may be made by a person skilled in this field of art without deviating from the principle and essence of the present invention. The scope of the present invention is defined by the claims or their equivalence.

What is claimed is:

1. A control system that controls a table lamp;

the table lamp comprises a base, a main shaft fixedly mounted on the base, a primary lamp connected to the main shaft via a first branch, and a secondary lamp connected also to the main shaft via a second branch; lights illuminated by the primary lamp define the first illumination tier: lights illuminated by the secondary lamp define the second illumination tier; the secondary lamp is positioned higher than the primary lamp; the second illumination tier of the secondary lamp covers the first illumination tier of the primary lamp; wherein the control system comprises a control center, a wireless emission module, a mechanism control module, a human-machine interface module, a communication module and a power control module; wherein, the control center is a command center of the entire control system; the control center controls brightness, color temperatures, glaring, operation time and user's preferred operation of the table lamp, and provides information input and output; the mechanism control module adjusts positions and angles of the first and second illumination tiers via mechanical movements of power arms.

2. The control system of claim 1, wherein the human-machine interface module comprises a visual image unit, a receiver unit, and an operative movement unit; operative movements that achieve control purpose is implemented through the operative movement unit; the receiver unit receives the operative movements; and the visual image unit recognizes the operative movements and outputs corresponding command codes.

3. The control system of claim 1, wherein the mechanism control module adjusts illuminating ranges of the first and second illumination tiers via mechanical movements of the power arms.

4. The control system of claim 1, wherein the communication module comprises an Ethernet, 3G/4G network, and a mobile terminal to achieve intelligent network communication.

5. The control system of claim 1, wherein a charging port is provided on the base to charge the table lamp; a control knob provided on the base simultaneously controls the primary lamp and the secondary lamp; the primary lamp and the secondary lamp are simultaneously activated by the control knob; different color temperatures of the primary lamp and the secondary lamp are also simultaneously switched by using the control knob; and brightness of both the primary lamp and the secondary lamp are also simultaneously adjustable by using the control knob.

6. The control system of claim 1, wherein a frame that connects the primary lamp and the secondary lamp is adjustable with respect to its height and angle; a distance between the primary lamp and the secondary lamp is 10 cm-25 cm.

7. The control system of claim 1, wherein the first illumination tier is positioned below the second illumination tier; the first illumination tier illuminates lights having homogeneous intensity, an illumination height lower than the second illumination tier, illuminance stronger than the second illumination tier, and an area of coverage smaller than the second illumination tier; the second illumination tier is positioned above the first illumination tier; the second illumination tier illuminates lights having homogeneous intensity, an illumination height higher than the first illumination tier, illuminance weaker than the first illumination tier and an area of coverage larger than the first illumination tier;

the area of coverage of the lights illuminated by the second illumination tier superimposes the area of coverage of the lights illuminated by the first illumination tier so that the lights from the second illumination tier and the lights from the first illumination tier are mixed at a predetermined ratio.

8. The control system of claim 7, wherein heights and angles of both the first illumination tier and the second illumination tier are adjustable.

9. The control system of claim 7, wherein the first illumination tier and the second illumination tier are simultaneously activated; brightness and color temperatures of both the first illumination tier and the second illumination tier are simultaneously adjustable using a control knob.

* * * * *